US010501943B1

(12) United States Patent
Peterson

(10) Patent No.: US 10,501,943 B1
(45) Date of Patent: Dec. 10, 2019

(54) SYSTEMS AND METHODS FOR INSTALLING FLOORING

(71) Applicant: Robert L. Peterson, Elkhorn, WI (US)

(72) Inventor: Robert L. Peterson, Elkhorn, WI (US)

(73) Assignee: CUSTOM FINISH WOOD FLOORING LLC, Elkhorn, WI (US)

( * ) Notice: Subject to any disclaimer, the term of this patent is extended or adjusted under 35 U.S.C. 154(b) by 0 days.

(21) Appl. No.: 15/436,004

(22) Filed: Feb. 17, 2017

Related U.S. Application Data

(60) Provisional application No. 62/297,205, filed on Feb. 19, 2016.

(51) Int. Cl.
*E04F 15/02* (2006.01)
*E04F 15/04* (2006.01)

(52) U.S. Cl.
CPC ..... *E04F 15/02038* (2013.01); *E04F 15/04* (2013.01); *E04F 2201/0107* (2013.01); *E04F 2201/023* (2013.01)

(58) Field of Classification Search
CPC ..... E04F 15/02038; E04F 15/04; E04F 2201/0107; E04F 2201/023
See application file for complete search history.

(56) References Cited

U.S. PATENT DOCUMENTS 168,672 A * 10/1875 Reed ..... E04F 15/04 52/589.1
193,833 A * 8/1877 Ritchel ..... E04F 15/04 52/578
304,584 A * 9/1884 Tunis ..... E04F 15/04 52/578
329,616 A * 11/1885 Baldwin ..... E04F 15/04 52/578
482,536 A * 9/1892 Zagelmeyer ..... E01C 5/14 404/46
598,437 A * 2/1898 Piver ..... E04F 15/04 52/313
624,862 A * 5/1899 Piver ..... E04F 15/04 52/578
714,987 A * 12/1902 Wolfe ..... E04F 15/04 52/578
883,049 A * 3/1908 Piver ..... E04F 15/04 144/354
935,402 A * 9/1909 Piver ..... E04F 15/04 52/578
1,124,228 A * 1/1915 Houston ..... E04F 15/04 403/381
1,407,679 A * 2/1922 Ruthrauff ..... E04F 15/04 52/480
1,764,331 A * 6/1930 Moratz ..... E04F 15/04 144/353
2,152,694 A * 4/1939 Hoover ..... E04F 15/04 52/364
2,283,135 A * 5/1942 Bruce ..... E04F 15/04 52/591.1
3,055,065 A * 9/1962 Elmendorf ..... E04F 15/04 428/106

(Continued)

*Primary Examiner* — James M Ference
(74) *Attorney, Agent, or Firm* — Smith Keane LLP

(57) ABSTRACT

Systems and methods directed to the art of installing flooring include untreated flooring planks having a hardwood top surface delivered to a jobsite and including improved thickness tolerances and/or top surface comparative coefficients of friction.

17 Claims, 4 Drawing Sheets

(56) References Cited

U.S. PATENT DOCUMENTS

RE26,239 E * 7/1967 Rockabrand et al. .. E04F 15/22 267/153
4,320,898 A * 3/1982 Brunst ..... A63D 1/00 428/172
4,644,720 A * 2/1987 Schneider ..... E04F 15/022 52/392
4,831,806 A * 5/1989 Niese ..... E04F 15/18 52/391
4,930,280 A * 6/1990 Abendroth ..... E04F 15/04 52/403.1
5,050,653 A * 9/1991 Brown ..... B27M 3/006 144/347
5,052,452 A * 10/1991 Goenner ..... B27L 5/06 144/4.9
5,113,632 A * 5/1992 Hanson ..... B27F 1/16 403/364
5,117,603 A * 6/1992 Weintraub ..... E04F 15/04 52/390
5,299,400 A * 4/1994 Sing ..... B27M 3/0053 144/340
5,352,317 A * 10/1994 Traben ..... B27L 5/06 144/120
5,474,831 A * 12/1995 Nystrom ..... B27B 1/00 404/46
5,570,554 A * 11/1996 Searer ..... E04F 15/02033 52/539
5,881,786 A * 3/1999 Wilderman ..... B27B 1/007 144/3.1
6,119,423 A * 9/2000 Costantino ..... B44C 5/043 52/313
6,148,884 A * 11/2000 Bolyard ..... B23D 45/105 144/114.1
6,336,484 B1 * 1/2002 Grenier ..... B27M 3/006 144/347
6,397,548 B1 * 6/2002 Martin ..... E04B 1/6125 403/334
6,460,583 B1 * 10/2002 Lindal ..... B27M 3/004 144/347
6,675,544 B1 * 1/2004 Ou ..... E04F 13/10 52/539
6,800,353 B1 * 10/2004 Anderson ..... C09D 5/008 428/141
6,968,664 B2 * 11/2005 Thiers ..... E04F 15/02 52/592.1
7,155,871 B1 * 1/2007 Stone ..... B32B 27/00 428/189
7,644,556 B2 * 1/2010 Grohman ..... E04F 15/02 52/539
7,837,078 B2 * 11/2010 Clark ..... B25C 3/006 227/107
8,201,600 B2 * 6/2012 Birkett ..... B05D 7/06 144/344
8,225,574 B2 * 7/2012 Croskrey ..... E04F 15/04 52/578
8,919,063 B2 * 12/2014 Oldorff ..... E04F 15/02 428/192
9,156,233 B2 * 10/2015 Dossche ..... B32B 21/04
2003/0009971 A1 * 1/2003 Palmberg ..... E04F 15/02 52/578
2004/0226243 A1 * 11/2004 Lin ..... B32B 3/10 52/384
2005/0166516 A1 * 8/2005 Pervan ..... E04F 15/02 52/589.1
2006/0010820 A1 * 1/2006 Schwitte ..... E04F 13/0826 52/592.1
2006/0037270 A1 * 2/2006 Niese ..... E04F 15/04 52/578
2006/0070325 A1 * 4/2006 Magnusson ..... B32B 3/06 52/403.1
2006/0130421 A1 * 6/2006 Nollet ..... B44B 5/026 52/582.1
2006/0156672 A1 * 7/2006 Laurent ..... B44C 1/24 52/589.1
2007/0224353 A1 * 9/2007 Forak ..... B05D 3/0218 427/317
2007/0292656 A1 * 12/2007 Handojo ..... B27D 1/06 428/106
2008/0047212 A1 * 2/2008 Scoville ..... E04C 2/16 52/506.01
2008/0184647 A1 * 8/2008 Yau ..... E04F 15/02033 52/589.1
2008/0226932 A1 * 9/2008 Kingma ..... A63B 49/02 428/541
2009/0077919 A1 * 3/2009 Fam ..... E04F 15/04 52/592.1
2009/0269522 A1 * 10/2009 Liu ..... E04L 35/12 428/33
2009/0320402 A1 * 12/2009 Schacht ..... E04F 15/02 52/588.1
2010/0192793 A1 * 8/2010 Verhaeghe ..... B44C 1/24 101/492
2011/0016818 A1 * 1/2011 Trudel ..... E04F 15/04 52/588.1
2011/0023302 A1 * 2/2011 Pervan ..... B23D 43/04 29/897.3
2011/0023303 A1 * 2/2011 Pervan ..... B27F 1/06 29/897.3
2011/0271632 A1 * 11/2011 Cappelle ..... E04F 15/02 52/582.2
2011/0284131 A1 * 11/2011 Trudel ..... B27F 1/06 144/357
2012/0286092 A1 * 11/2012 Lu ..... B64C 1/18 244/119
2013/0008118 A1 * 1/2013 Baert ..... B29C 63/044 52/588.1
2013/0104478 A1 * 5/2013 Meersseman ..... E04F 13/0894 52/309.1
2014/0373472 A1 * 12/2014 Plummer ..... E04F 15/187 52/302.3
2015/0191917 A1 * 7/2015 Chou ..... E04F 15/045 52/588.1
2016/0185007 A1 * 6/2016 Tarn ..... G05B 19/4097 144/346
2016/0368701 A1 * 12/2016 Stoll ..... B65D 85/62

* cited by examiner

SYSTEMS AND METHODS FOR INSTALLING FLOORING

RELATED APPLICATIONS

This application claims the benefit of U.S. Provisional Patent Application Ser. No. 62/297,205, filed 19 Feb. 2016, and titled "Systems and Methods for Installing Natural Wood Flooring," which is incorporated herein by reference in its entirety.

BACKGROUND OF THE INVENTION

Systems and methods according to the present invention relate generally to building construction materials and construction methods, and more particularly to flooring systems employing natural wood, either solid natural wood or including a natural wood veneer.

Presently, most hardwood (e.g., oak, maple, hickory, etc.) flooring provided to a jobsite for either do-it-yourselfers or even professional installers suffers from at least one of two deficiencies, namely, surface height variation and/or finish. Either of these deficiencies can lead to further required expenditures to complete a uniform installation.

A deficiency of surface height variation is indicated by adjacent boards forming an offset lip defined by a height difference between an untreated top surface of one board and an untreated top surface of an adjacent board. Such lips may be caused by a variation in overall plank thickness of adjacent boards and/or variation of partial plank thicknesses caused by mating constructs (e.g., tongue and groove, overlapping, or click) of adjacent boards.

A deficiency in finish may be indicated by relatively rough surfaces having a noticeably high coefficient of friction, as further explained below, or stained and/or protected surfaces. A problem with stained flooring presented to a jobsite is that there is a chance that the stain shade of presented stained flooring may not match existing stained flooring. A problem with protected flooring is that a desired sheen may not have been achieved.

To accommodate prior flooring exhibiting thickness variation, flooring installers would normally secure flooring planks to flooring joists or underlayment. Immediately after securing the flooring planks, offset lips at one or more places along the exposed flooring surface are usually detected. To substantially eliminate the offset lips, significant surface treatment, such as sanding, was required.

Significant surface treatment (e.g. sanding) was also used to accommodate prior flooring planks exhibiting undesirable rough surface characteristics. Regarding stain color and protectant sheen, if the product delivered to a jobsite does not meet expectations, either additional finishing efforts were required, or entirely new product would need to be ordered, thus causing delay in job completion.

Accordingly, the art of flooring installation, and especially flooring installation adjoining a preexisting wood floor at a jobsite, could benefit from systems and methods related to supplying untreated (e.g., unstained) but more precise flooring planks with hardwood top surfaces.

SUMMARY OF THE INVENTION

The present invention relates to improved systems and method related to supplying and installing hardwood flooring planks to address one or more problems experienced heretofore with prior flooring planks provided to a jobsite and/or to provide alternative advantages as described herein.

According to an aspect of an embodiment of a flooring system according to the present invention, the system includes a plurality of planks including at least a first plank and a second plank. The first plank has a length, a bottom surface and an untreated hardwood plank top surface disposed opposite the bottom surface and separated therefrom by a first plank thickness. The first plank may also include a first plank tongue extending along and perpendicular to the first plank length, the tongue having a tongue top surface and a tongue bottom surface. The second plank has a length, a bottom surface and an untreated hardwood top surface disposed opposite the bottom surface and separated therefrom by a second plank thickness. The second plank may include structure to mate with the first plank, such as a groove extending along and perpendicular to the second plank length, the groove having a groove top surface and a groove bottom surface. The groove may be configured to receive the first plank tongue, wherein when the tongue and groove, or other mating structure, are mated, the maximum distance between the first plank top surface and the second plank top surface (such as along mating top surface edges) defines a differential height, which is preferably less than or equal to 0.50 mm, more preferably less than or equal to 0.30 mm, and most preferably less than or equal to 0.25 mm. The planks may be solid hardwood or engineered hardwood, or the untreated hardwood top surface may be a veneer, such as applied to an engineered substrate.

According to another aspect of an embodiment of a flooring system according to the present invention, the first plank further has a first flange height extending from the tongue top surface to a nearest edge of the first plank untreated hardwood top surface and a second flange height extending from the tongue bottom surface to the nearest edge of the first plank untreated hardwood top surface. The second plank further has a first tab height extending from the groove top surface to a nearest edge of the second plank untreated hardwood top surface; and a second tab height extending from the groove bottom surface to the nearest edge of the second plank untreated hardwood top surface. If the first plank thickness is greater than the second plank thickness, any difference between the first tab height and the first flange height is preferably less than or equal to 0.50 mm, more preferably less than or equal to 0.30 mm, and most preferably less than or equal to 0.25 mm. If the second plank thickness is greater than the first plank thickness, any difference between the second tab height and the second flange height is preferably less than or equal to 0.50 mm, more preferably less than or equal to 0.30 mm, and most preferably less than or equal to 0.25 mm.

According to still another aspect of an embodiment of a flooring system according to the present invention, the top surfaces of the two planks are preferably mechanically treated to provide a relative static friction coefficient of the first plank untreated hardwood top surface against the second plank untreated hardwood top surface of preferably about 0.15 to about 0.30, and most preferably about 0.15 to about 0.25.

According to yet another aspect of an embodiment of a flooring system according to the present invention, at least one of the first plank untreated hardwood top surface and the second plank untreated hardwood top surface comprises mechanical treatment, such as at least one of planing, sanding, scraping, and brushing.

According to an aspect of an embodiment of a method according to the present invention, such method includes the steps of obtaining a flooring system according to the present invention and delivering the flooring system to a jobsite. The method may further include the steps of mating the first plank tongue and the second plank groove and securing the first plank and the second plank to a subfloor, preferably prior to any chemical treatment of the top plank surfaces.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Turning now to the Figures, a first embodiment 100 of a hardwood plank flooring surface is shown, formed by a plurality of planks 110. The hardwood plank may be solid hardwood (i.e., harvested from a tree having broad leaves, producing a fruit or nut, and going dormant in the winter, such as alder, oak, cherry, maple, birch, etc.) or a hardwood veneer may form a surface thereof. For a number of various reasons, it may be desirable to longitudinally expand the flooring surface in a direction at least substantially parallel with a length 110*a* of the flooring planks 110 and/or laterally expand the flooring surface in a direction at least substantially parallel with a width 110*b* of the flooring planks 110. Alternatively or additionally, it may be desirable to install an entirely new flooring surface after removing the existing surface 100.

Figure 1:
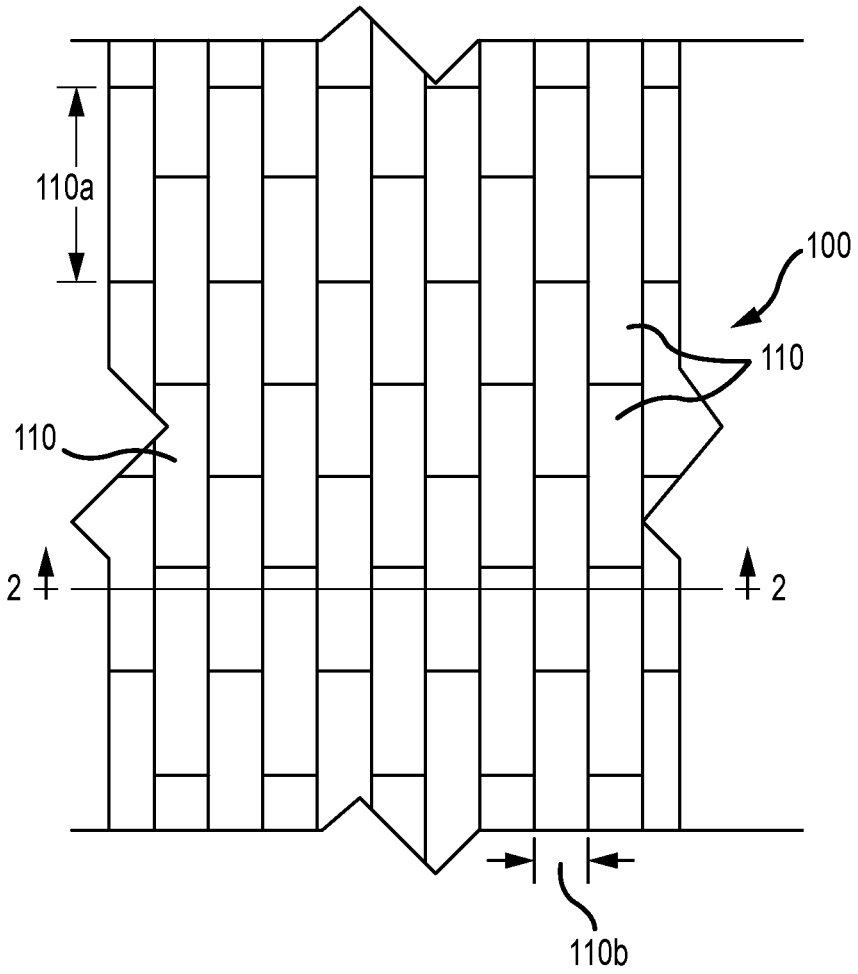
FIG. 1 is a top plan view of a conventional hardwood plank floor terminating along a carpeted edge.
Figure 2:
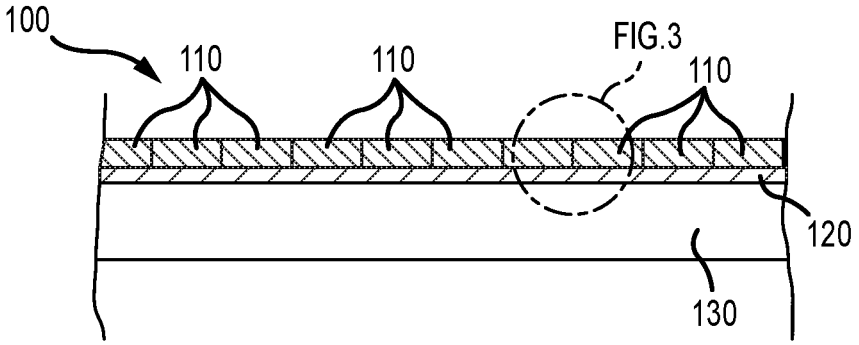
FIG. 2 is a cross-sectional view taken along line 2-2 of FIG. 1.
Figure 3:
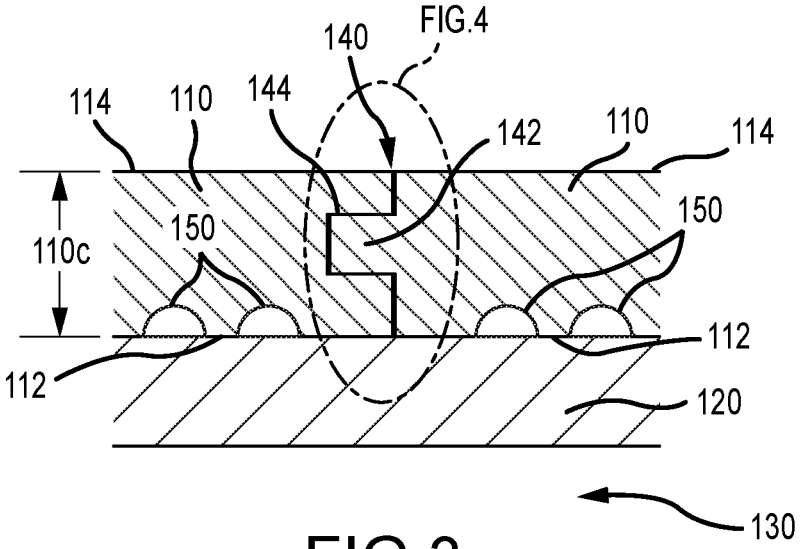
FIG. 3 is a cross-sectional elevation view taken from FIG. 2.

FIG. 2 is a cross-sectional view taken through a plurality of planks 110 of an installed, finished floor. With reference also to FIG. 3 as a close-up view of FIG. 2, the planks 110 are usually fastened or adhered to a subfloor 120, such as plywood, which is in turn secured to a floor joist 130. Alternatively, the planks 110 may be secured directly to the floor joist 130. Alternatively, the planks 110 may be secured to a different substrate, such as a concrete floor (not shown). The planks 110 may include several features known in the art to assist in installation, such as tongue-and-groove joints 140 and base surface kerfs 150. Each plank 110 generally includes a length 110*a* and width 110*b*, as mentioned above, but further includes a thickness 110*c*, the thickness 110*c* extending between and including a bottom surface 112 and an untreated hardwood top surface 114. While lengths 110*a* may vary from plank to plank, or be provided as substantially similar, preferred widths 110*b* are preferably about 25 millimeters (about one inch) to about 410 millimeters (about 16 inches). The top surface 114 may be formed of the same material that comprises the remainder of the plank 110 (e.g., hardwood) or the surface 114 may be provided as a laminate layer of an operable thickness. Preferred plank thicknesses 110*c* are between about 6.3 millimeters (about ¼ inch) and about 51 millimeters (about two inches). Mating tongue-and-groove joints 140 may be provided along the length 110*a* and may also be provided along the width 110*b* of the planks 110. Each joint 140 may be formed by mating structure on adjacent planks 110, including a longitudinal rib or tongue 142 formed on a first plank 110 and a longitudinal slot or groove 144 formed into a second, adjacent plank 110.

In an installed and finished floor, it is preferable to have the mating portions of top surfaces 114 of adjacent planks 110 form an at least substantially continuous or even flooring surface, as seen in FIG. 3. An acceptable finished floor usually includes a minimal difference between finished heights of adjacent planks 110. It is estimated that a completed floor having a maximum height difference between adjacent plank top surfaces 114 over a majority of the floor of 0-0.5 millimeters is preferred, with less than 0.3 millimeters is more preferred, and less than 0.25 millimeters being most preferred.

Figure 4A:
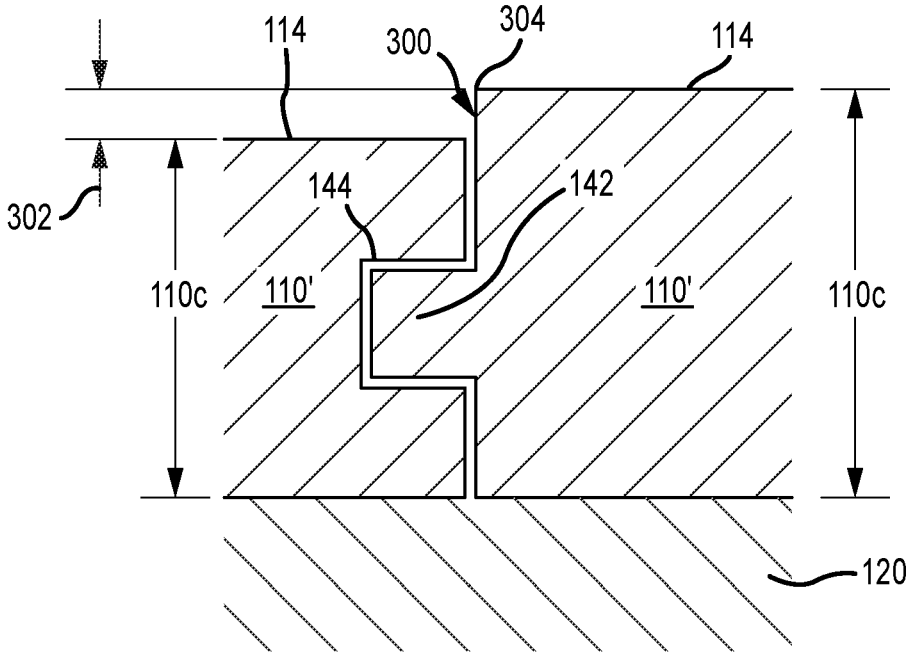
FIG. 4A is a first alternative cross-sectional elevation view taken from FIG. 3.

As mentioned above, conventional flooring planks provided to a jobsite generally have undesirable variations that may lead to costly efforts to produce an acceptable flooring surface. For instance, prior planks 110' have been previously delivered to a jobsite and installed. After installation, however (and with reference to FIG. 4A) it has been noticed that a joint lip 300 may be created, having a differential height 302 (measured between adjacent plank top surfaces 114 of greater than is desirable, such as greater than 0.5 millimeters. In the depicted situation, though the tongue 142 and groove 144 are aligned when the bottom plank surfaces 112 are placed against the subfloor 120 or other supporting surface, the overall plank heights (or thicknesses) 110*c*' are different, thereby causing the differential height 302. The overall plank height 110*c*' may be measured at least substantially perpendicular to the subfloor 120 or perpendicular to the general expanse of the floor, up to a topmost edge 304 (or otherwise thickest portion) of the respective plank 110'. The topmost edge 304 may be provided at a seam formed by the top surfaces 114 of the two planks 110' or may be spaced therefrom. Though shown herein as having a squared-off corner 304 forming the lip 300, the corner (or other topmost part) 304 may be set back towards a medial longitudinal axis of a plank by some modification of the plank, such as by chamfering or distressing one or both longitudinal edges of the plank.

Figure 4B:
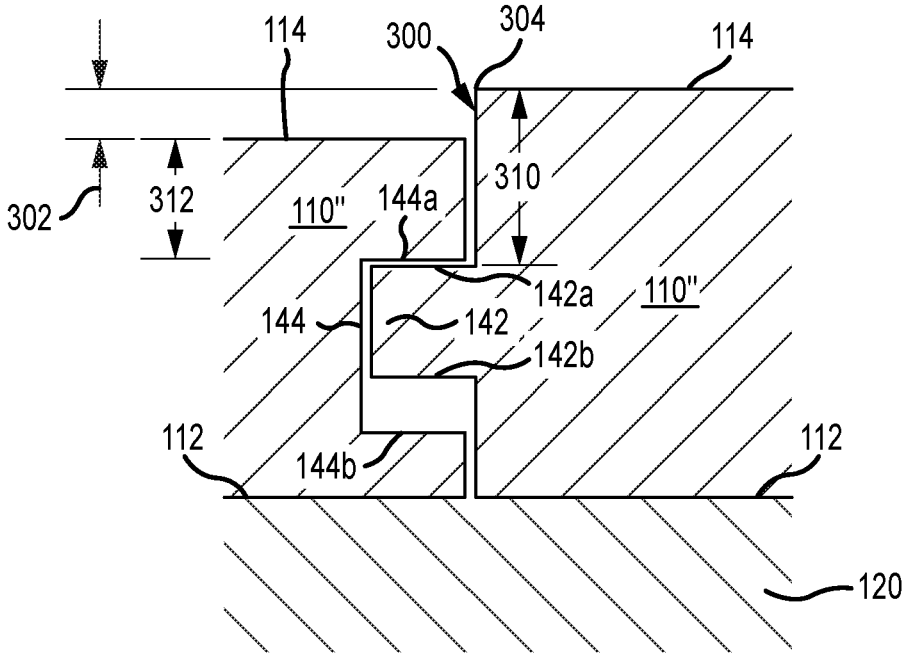
FIG. 4B is a second alternative cross-sectional elevation view taken from FIG. 3.

The displacement 302 between top surfaces 114 of adjacent planks 110 may be affected by differences in plank thickness 110*c*, but may be more substantially affected by variations in height differences between a top plank surface 114 and a joining structure, such as a corresponding mating tongue 142 or groove 144. Turning now to FIG. 4B, it can be seen that a top surface 142*a* of a tongue 142 is forced or rests against a top surface 144*a* of a groove 144, and a flange height 310 measured between the tongue top surface 142*a* and the topmost point 304 is greater than a tab height 312 measured between the groove top surface 144*a* and the plank top surface 114, thereby causing an undesirable lip 300 at a differential height 302. While it is shown that the flange height 310 is measured from the tongue top surface 142*a*, it could instead be measured from a bottom surface 142*b* of the tongue 142 (see 310' in FIG. 4C) and compared to a tab height 312 measured from a bottom surface 144*b* of the groove 144 (see 312' in FIG. 4C), if such bottom surfaces 142*b*,144*b* were forced or rested against each other.

Figure 4C:
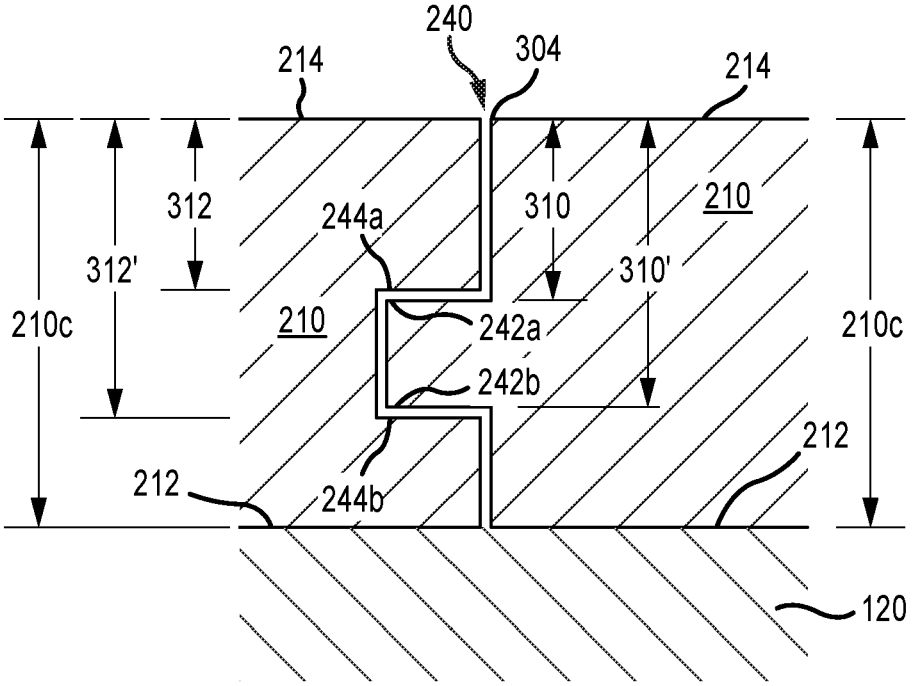
FIG. 4C is a third, substitute cross-sectional elevation view taken from FIG. 3 featuring planks according to the present invention rather than conventional planks.

FIG. 4C depicts a preferred embodiment 210 of planks according to the present invention. A plurality of planks 210 is provided to a jobsite. The planks 210 are produced to a tight tolerance to ensure minimal variance to minimize any sort of lip 300 as described previously. Thus, the topmost point 304 of a first plank 210 is, upon installation, disposed preferably no more than 0.50 millimeters above the top surface 214 of the adjacent plank 210. In the depiction shown, the top surface 214 of the left plank 210 is horizontally level with the topmost point 304 of the right plank 210, thereby eliminating any lip 300. Thus, for a plurality of provided planks 210, a lip 300 of less than 0.5 millimeters is preferably provided along an entire length of engagement between any two of the plurality of planks 210. Such lesser lip 300 may be provided by ensuring that the plank thicknesses 210*c* are less than 0.5 millimeters different. If a first plank 210 at a joint 240 provides a tongue 242, and that plank thickness 210*c* is greater than the thickness 210*c* of the adjoining plank 210, by more than 0.5 millimeters, a lesser lip 300 may still be achieved by ensuring that the tab height 312 is not greater than or less than the flange height 310 by more than 0.5 millimeters. If a second plank 210 at a joint 240 provides a groove 244, and that plank thickness 210*c* is greater than the thickness 210*c* of the adjoining plank 210, by more than 0.5 millimeters, a lesser lip 300 may still be achieved by ensuring that the tab height 312' is not greater than or less than the flange height 310' by more than 0.5 millimeters. More generally speaking, if upon installation a tongue top surface 242*a* engages a groove top surface 244*a*, then the absolute value of the flange height 310 minus the tab height 312 is preferably less than 0.5 millimeters. Alternatively or additionally, if upon installation a tongue bottom surface 242*b* engages a groove bottom surface 244*b*, then the absolute value of the flange height 310' minus the tab height 312' is preferably less than 0.5 millimeters. Though described with respect to a tongue-and-groove mating structure, it is to be understood that the goal of the present invention may also be achieved with other mating structures, such as an overlap or a click mating structure. In the event of other mating structures used, corresponding flange and tab heights 310,312 may be defined with relation to mating structure of adjacent planks 110, where such mating structure impedes relative movement of such planks 110 in a direction that is generally parallel to the thickness 110*c* of the planks 110.

Figure 5:
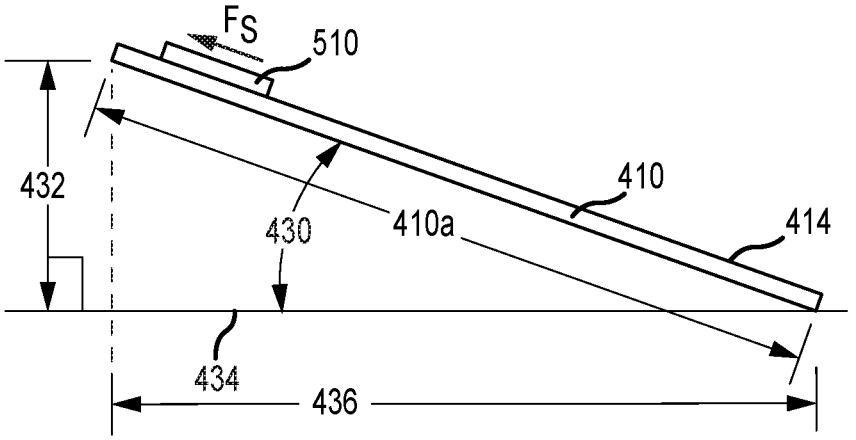
FIG. 5 is an elevation diagram of an experimental setup.

Mechanical surface treatment of planks to be provided to a jobsite according to the present invention preferably includes smoothing out the planks (e.g., planing, sanding, etc.) to a desired smoothness to ease finishing treatment requirements. As used herein, "untreated" should be understood to mean that although a surface of a plank has undergone mechanical treatment (e.g., planning, sanding, scraping, brushing), it is provided as a bare hardwood surface, which has not received chemical treatment, such as staining, sealing, painting. A desired smoothness has been discovered to be indicated by static coefficient of friction determined by experiments conducted according to FIG. 5. A first plank 410 having a length 410*a* is placed on a horizontal surface 434 and a second plank 510 is placed on top of the first plank 410, with the top surfaces 414,514 in contact (i.e., the second plank 510 was placed face down). The first plank 410 is then slowly elevated to determine at what angle 430 the length 410*a* of the first plank 410 is positioned with respect to the horizontal surface 434 (and/or measuring a height 432 of the length 410*a* from the horizontal surface 434) when the second plank 510 begins to move, thus indicating a component of the force of gravity overcoming any static friction force ($F_e$) between the two planks. While tests were run firstly with smaller experimental pieces, first planks having a mass of greater than 0.5 kilograms seemed to demonstrate more consistent results.

To calculate the static friction forces ($F_s$), the known formula of F=ma (force equals mass times acceleration) may be used. The mass was measured, and the acceleration used can be an amount of the force of gravity. Accordingly, the fraction of the gravitational acceleration moving in the direction of the first plank 410 is equal to the sine of the angle 430 at which the second plank 510 begins moving along the first plank 410. The sine of the angle 430 may also be calculated by finding the quotient of the height 432 divided by the length 410*a*. Thus, the static friction force ($F_s$) may be calculated by multiplying the measured mass (in kilograms) by gravitational acceleration (9.81 m/s$^2$) and the quotient of the height 432 divided by the length 410*a*, illustrated in the following equation:

$$F_s = m*g*(\text{height/length})$$

To calculate desired coefficients of static friction, the height 432 of the first plank 410 at which the second plank 510 plank begins to slide is divided by a horizontal distance 436 measured along the horizontal surface 434 to the ends of the first plank 410. Alternatively, knowing the length 410*a* of the first plank 410, the horizontal distance 436 may be calculated by finding the square root of the difference between the length 410*a* squared and the height 432 squared.

The average results of the experiments run are shown in the following table:

| Planks | Mass | Length (410a) | Height (432) | Horizontal Distance (436) | $F_s$ | Coeff. |
|---|---|---|---|---|---|---|
| Prior Art | 688 g | 2.00 m | 0.62 m | 1.90 m | 2.09N | 0.32 |
| According to this invention | 630 g | 2.00 m | 0.46 m | 1.95 m | 1.42N | 0.24 |

Thus, it can be concluded that a coefficient of static friction between two planks delivered to a jobsite according to the present invention is preferably in the range of about 0.15 to less than about 0.30, and more preferably in the range of about 0.15 to less than about 0.25, when measured and calculated as described herein.

Additionally or alternatively, one or more other surface treatments (in addition to or alternatively to sanding/planing) may be undertaken on the top surface 114 of a plank 110 according to the present invention. A plank 110 may be provided with a varying thickness across its width 110*b*, such as with hand scraping, or imitation thereof. The top surface 114 may be distressed, such as by striking the surface 114 with various implements to create dents, dings, or other impressions. The top surface 114 may be brushed, such as with a wire brush sander.

To produce planks according to the present invention, tight production control may be used, including sharp tools and post-production inspection. Planks including one or more features as disclosed herein may then be collected for delivery to a jobsite. The collection may be simply stacking a plurality of planks on a vehicle and transporting them to a jobsite, or may further include bundling and/or packaging the planks. Packaging of the planks may make delivery to a jobsite more efficient. Preferably, the one or more features included in planks according to the present invention (the tolerances and variances (including coefficient of friction)) can be observed by comparing any two of the plurality of planks delivered to a jobsite. Planks according to the present invention provided to a jobsite and thereafter installed provide easier finishing, requiring generally only buffing, and chemical treatment, such as stain application, and/or other fluid protective application (e.g., polyurethane, tung oil, etc.).

As used herein, the phrase "provided to a jobsite" or "delivered to a jobsite" indicates that the material so provided is intended to be installed at the jobsite (e.g., in the room, building, or on the property parcel) in the state provided, without further modification. Any additional treatment of the material (e.g. intentional modification of plank top surfaces 114) is then undertaken after the material is installed (e.g. buffing, staining, and/or protecting).

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A plurality of unassembled individual planks adapted to be assembled to form a floor; the plurality of unassembled individual planks including:

at least a first plank and a second plank, each of which consists of solid hardwood;

the first plank comprising a first plank length, a first plank bottom surface, a first untreated hardwood plank top surface disposed opposite the first plank bottom surface and separated therefrom by a first plank thickness, and a first plank tongue extending along and perpendicular to the first plank length, the first plank tongue having a tongue top surface and a tongue bottom surface;

the second plank comprising a second plank length, a second plank bottom surface, a second untreated hardwood plank top surface disposed opposite the second plank bottom surface and separated therefrom by a second plank thickness, and a second plank groove extending along and perpendicular to the second plank length, the second plank groove having a groove top surface and a groove bottom surface;

wherein the second plank groove is configured to receive the first plank tongue, and wherein, with the first plank tongue received in the second plank groove, a difference in height measured substantially perpendicularly from the first plank top surface to the second plank top surface defines a differential height; and the differential height is less than or equal to 0.50 mm; and wherein the static friction coefficient of the first plank untreated hardwood top surface against the second plank untreated hardwood top surface is about 0.15 to about 0.30.

2. The plurality of unassembled individual planks of claim 1, wherein the differential height is less than or equal to 0.30 mm.

3. The plurality of unassembled individual planks of claim 1 wherein the differential height is less than or equal to 0.25 mm.

4. The plurality of unassembled individual planks of claim 1, the first plank further comprising:

a first flange height extending from the tongue top surface to a nearest edge of the first plank untreated hardwood top surface; and a second flange height extending from the tongue bottom surface to the nearest edge of the first plank untreated hardwood top surface;

the second plank further comprising:

a first tab height extending from the groove top surface to a nearest edge of the second plank untreated hardwood top surface; and a second tab height extending from the groove bottom surface to the nearest edge of the second plank untreated hardwood top surface, wherein if the first plank thickness is greater than the second plank thickness, any difference between the first tab height and the first flange height is less than or equal to 0.50 mm, and wherein if the second plank thickness is greater than the first plank thickness, any difference between the second tab height and the second flange height is less than or equal to 0.50 mm.

5. The plurality of unassembled individual planks of claim 4, wherein if the first plank thickness is greater than the second plank thickness, any difference between the first tab height and the first flange height is less than or equal to 0.30 mm; and wherein if the second plank thickness is greater than the first plank thickness, any difference between the second tab height and the second flange height is less than or equal to 0.30 mm.

6. The plurality of unassembled individual planks of claim 4, wherein if the first plank thickness is greater than the second plank thickness, any difference between the first tab height and the first flange height is less than or equal to 0.25 mm; and wherein if the second plank thickness is greater than the first plank thickness, any difference between the second tab height and the second flange height is less than or equal to 0.25 mm.

7. The plurality of unassembled individual planks of claim 1, wherein the static friction coefficient of the first plank untreated hardwood top surface against the second plank untreated hardwood top surface is about 0.15 to about 0.25.

8. The plurality of unassembled individual planks of claim 1, wherein at least one of the first plank untreated hardwood top surface and the second plank untreated hardwood top surface comprises mechanical treatment.

9. The plurality of unassembled individual planks of claim 8, wherein the mechanical treatment is at least one of: planning, sanding, scraping, and brushing.

10. A method comprising the steps of:

obtaining the plurality of unassembled individual planks of claim 1; and delivering the plurality of unassembled individual planks to a jobsite, and assembling the first and second planks into an assembled flooring system, and finishing the assembled flooring system without rough sanding of the flooring system.

11. The method of claim 10, further comprising the steps of:

mating the first plank tongue and the second plank groove; and securing the first plank and the second plank to a subfloor.

12. The method of claim 10, wherein the differential height is less than or equal to 0.30 mm.

13. The method of claim 10, wherein the differential height is less than or equal to 0.25 mm.

14. The method of claim 10, the first plank further comprising:

a first flange height extending from the tongue top surface to a nearest edge of the first plank untreated hardwood top surface; and a second flange height extending from the tongue bottom surface to the nearest edge of the first plank untreated hardwood top surface;

the second plank further comprising:

a first tab height extending from the groove top surface to a nearest edge of the second plank untreated hardwood top surface; and a second tab height extending from the groove bottom surface to the nearest edge of the second plank untreated hardwood top surface, wherein if the first plank thickness is greater than the second plank thickness, any difference between the first tab height and the first flange height is less than or equal to 0.50 mm, and wherein if the second plank thickness is greater than the first plank thickness, any difference between the second tab height and the second flange height is less than or equal to 0.50 mm.

15. The method of claim 14, wherein if the first plank thickness is greater than the second plank thickness, any difference between the first tab height and the first flange height is less than or equal to 0.30 mm; and wherein if the second plank thickness is greater than the first plank thickness, any difference between the second tab height and the second flange height is less than or equal to 0.30 mm.

16. The method of claim 14, wherein if the first plank thickness is greater than the second plank thickness, any difference between the first tab height and the first flange height is less than or equal to 0.25 mm; and wherein if the second plank thickness is greater than the first plank thickness, any difference between the second tab height and the second flange height is less than or equal to 0.25 mm.

17. The method of claim 10, wherein the static friction coefficient of the first plank untreated hardwood top surface against the second plank untreated hardwood top surface is about 0.15 to about 0.25.

* * * * *